US009526298B2

(12) United States Patent
Borel et al.

(10) Patent No.: US 9,526,298 B2
(45) Date of Patent: Dec. 27, 2016

(54) FOOTWEAR WITH IMPROVED SOLE ASSEMBLY

(75) Inventors: René Borel, Saint-Sylvestre (FR); Benjamin Grenet, Moye (FR); Patrick Leick, Villaz (FR)

(73) Assignee: SALOMON S.A.S., Metz-Tessy (FR)

( * ) Notice: Subject to any disclaimer, the term of this patent is extended or adjusted under 35 U.S.C. 154(b) by 709 days.

(21) Appl. No.: 13/553,004

(22) Filed: Jul. 19, 2012

(65) Prior Publication Data

US 2013/0019505 A1 Jan. 24, 2013

(30) Foreign Application Priority Data

Jul. 20, 2011 (FR) ..... 11 02264

(51) Int. Cl.

| | |
|---|---|
| ***A43B 13/00*** | (2006.01) |
| ***A43B 13/12*** | (2006.01) |
| ***A43B 13/14*** | (2006.01) |
| ***A43B 13/22*** | (2006.01) |

(52) U.S. Cl.

CPC ..... *A43B 13/127* (2013.01); *A43B 13/141* (2013.01); *A43B 13/223* (2013.01)

(58) Field of Classification Search

CPC ... A43B 13/127; A43B 13/223; A43B 13/141; A43B 13/12; A43B 13/122; A43B 13/16; A43B 13/20

USPC ..... 36/103, 28, 29, 3 B, 25 R

See application file for complete search history.

(56) References Cited

U.S. PATENT DOCUMENTS

| | | | | |
|---|---|---|---|---|
| 5,718,063 | A * | 2/1998 | Yamashita et al. | 36/28 |
| 5,815,949 | A * | 10/1998 | Sessa | 36/3 B |
| 6,321,469 | B1 | 11/2001 | Cretinon | |
| 6,754,982 | B2 * | 6/2004 | Reed et al. | 36/30 A |
| 7,013,581 | B2 * | 3/2006 | Greene et al. | 36/25 R |
| 7,487,602 | B2 * | 2/2009 | Berger et al. | 36/3 B |
| 7,647,709 | B2 * | 1/2010 | Reilly et al. | 36/30 R |
| 7,814,686 | B2 * | 10/2010 | Becker et al. | 36/102 |
| 8,365,440 | B2 * | 2/2013 | Rivas et al. | 36/30 R |
| 2004/0250446 | A1 | 12/2004 | Greene et al. | |
| 2006/0272180 | A1 * | 12/2006 | Hay | 36/25 R |
| 2007/0240331 | A1 * | 10/2007 | Borel | 36/28 |
| 2008/0216355 | A1 | 9/2008 | Becker et al. | |
| 2011/0185590 | A1 | 8/2011 | Nishiwaki et al. | |

FOREIGN PATENT DOCUMENTS

| | | |
|---|---|---|
| DE | 20 2010 015 777 U1 | 1/2011 |
| EP | 2 332 432 A1 | 6/2011 |

* cited by examiner

*Primary Examiner* — Jila M Mohandesi

(74) *Attorney, Agent, or Firm* — Greenblum & Bernstein, P.L.C.

(57) ABSTRACT

An article of footwear, such as a shoe including an outer sole assembly and an upper, the outer sole assembly extending length-wise from a rear end to a front end, and width-wise between a lateral side and a medial side, the outer sole assembly having a surface for contact with the ground, the outer sole assembly including a wear layer provided to take support on the ground, the wear layer having at least one through-opening, the outer sole assembly including at least one reinforcing layer arranged between the wear layer and the upper, the reinforcing layer extending at least in the area of the opening. A damping layer is arranged between the wear layer and the reinforcing layer.

37 Claims, 4 Drawing Sheets

FOOTWEAR WITH IMPROVED SOLE ASSEMBLY

CROSS-REFERENCE TO RELATED APPLICATION

This application is based upon French patent application Ser. No. 11/02264, filed Jul. 20, 2011, the disclosure of which is hereby incorporated by reference thereto in its entirety, and the priority of which is claimed under 35 U.S.C. §119.

BACKGROUND

1. Field of the Invention

The invention relates to footwear, and more particularly to an article of footwear, such as a shoe, intended for the practice of a sport.

Footwear of the invention encompasses that which can be used in disciplines such as walking, including power walking, running on either flat or mountainous terrain, climbing, skateboarding, a ball sport, or the like.

2. Background Information

Footwear, such as a shoe, can include a low upper, a mid-upper, or a high upper, i.e., an upper having an uppermost edge positioned, respectively, below the ankle, at or near the middle of the ankle, or above the ankle. The shoe can also be relatively flexible or more rigid. However, regardless of its general appearance or the sporting activity performed, the shoe should meet the expectations of the user.

In particular, it is desirable that the shoe minimize user fatigue, which requires a shoe structure having a reduced mass. This characteristic is important in all disciplines mentioned above, especially running and walking. Indeed, a reduced mass translates into low inertia and, therefore, less fatigue.

To reduce the mass of a shoe, it is known to provide through-openings in the wear layer, i.e., the outsole. The wear layer, which is provided to be supported on the ground, is generally comprised of rubber, a material having high adherence capability, but also high density. For this reason, openings can be provided to lighten the wear layer, and therefore the entire shoe.

In the fields of running or walking, for example, it is known to cut transverse slits in the wear layer. These slits lighten the shoe and also promote longitudinal bending of the outer sole assembly for facilitating a good foot rolling movement.

However, the openings in the wear layer occasionally give rise to punctures. Indeed, each opening constitutes an interruption of the wear layer, thereby forming a passageway for any foreign object that could become lodged therein. Such foreign objects may be pieces of minerals, branches, any of various ground projections, or small objects such as pebbles, debris, and the like. The introduction of a foreign object into an opening can cause deformation or deterioration of the outer sole assembly, and possibly injuries to the foot of the user.

To overcome the problem related to punctures, it is known to seal the bottom of an opening, at least partially, with a reinforcing layer arranged between the wear layer and the remainder of the sole assembly of the shoe. The reinforcing layer is generally comprised of a thin synthetic material. This provides the reinforcing layer with both puncture resistance and reduced mass, thus enabling the sole assembly to remain light.

Finally, a shoe made with openings in its wear layer is both lighter and more resistant to punctures. However, such a shoe has the disadvantage of having reduced ground-gripping ability. This means, for example, that the shoe can slip when subject to a force that would be insufficient to cause a shoe of equal size, but with no openings, to slip. This type of slip, or ill-timed sliding, can occur when applying a supporting force toward the ground, especially on an inclined surface, and when forces related to acceleration, braking, or the like, are exerted. As a result, walking or running is less precise, less safe and, paradoxically, causes user fatigue.

SUMMARY

In view of the preceding, the invention generally improves upon prior art footwear, such as shoes. In particular, the invention ensures that a shoe, in which the wear layer of the outer sole assembly has at least one through-opening and a reinforcing layer extending at least partially in the area of the opening, has ground grip characteristics that are at least equal to those of a shoe of equal size, but the wear layer of which has no through-openings. In more concise terms, the invention increases ground-gripping ability, despite the reduced surface of the wear/grip layer.

As described further below, the invention also provides a broad application of such gripping ability, that is to say, making it available on wet, damp, or soiled terrains, as well as on more predictable terrains, such as dry terrains.

The invention further provides a certain damping capability in the area of the outer sole assembly. The invention optimizes the behavior of the sole assembly during the entirety, or at least a significant portion, of its contact with the ground, depending upon the sporting activity performed, and/or the type of ground involved.

Further, the invention improves accuracy in the transmission of sensory information or forces related to walking or running.

Still further, the invention reduces the mass of the outer sole assembly as much as possible.

Additionally, the invention reconciles, in the same shoe, the capabilities of free and even rolling movement of the outer sole assembly on the ground, adequate grip on even ground, and adequate grip on uneven ground. This means such a shoe is versatile, more efficient in any situation and on any terrain.

To this end, the invention provides a shoe comprising an outer sole assembly and an upper, the outer sole assembly extending length-wise from a rear end to a front end, and width-wise between a lateral side and a medial side, the outer sole assembly having a ground-contacting surface, the outer sole assembly comprising a wear layer adapted to take support on the ground, the wear layer having at least one through-opening, the outer sole assembly comprising at least one reinforcing layer arranged between the wear layer and the upper, the reinforcing layer extending at least in the area of the opening.

The damping layer of a shoe according to the invention is arranged between the wear layer and the reinforcing layer.

The damping layer damps the impacts and forces associated with running or walking, or the sensory information transmitted between the wear layer and the reinforcing layer. In other words, the damping layer serves as a mechanical filter. As such, this layer permits small elastic, reversible displacements of subdivisions of the wear layer, or of the entire wear layer, with respect to the reinforcing layer.

Because the damping layer deforms elastically and reversibly, particularly in compression and/or shear, the damping layer absorbs excess energy related to supports, impacts, forces, changes in terrain or ground projections, or to the transmission of sensory information. As a result, more energy must be applied to the outer sole assembly, compared to a shoe having no damping layer, in order to cause ill-timed slip or sliding.

Among the resulting advantages, the shoe according to the invention has a better grip on the ground than a shoe whose sole assembly has no damping layer between the wear layer and the reinforcing layer.

The improved ground grip, in a shoe according to the invention, is achieved on various terrains, including wet, damp, dry, flat or sloped, smooth or uneven terrains, especially due to the effect of the "double crampon" or of an increase in the size of the crampon in the area of the contour of the openings.

Thus, the damping layer improves the behavior of the sole assembly during a significant portion, or even the entirety, of its contact with the ground.

The invention also improves accuracy in the transmission of sensory information or forces, because slips are reduced or nonexistent.

The invention minimizes user fatigue by imparting a reduced mass on the outer sole assembly, as the damping layer is lightweight, and by providing improved damping of impacts.

It will be shown more clearly below that, at least for one embodiment, the shoe of the invention combines the capabilities of free and even rolling movement of the outer sole assembly on the ground, adequate grip on even ground, and adequate grip on uneven ground. Therefore, the shoe is versatile and efficient in all situations.

BRIEF DESCRIPTION OF DRAWINGS

Other features and advantages of the invention will be better understood from the following description, with reference to the annexed drawings illustrating, by way of non-limiting embodiments, how the invention can be embodied, and in which.

DETAILED DESCRIPTION

The first embodiment described below relates more specifically to shoes for walking or running on flat or uneven terrain. However, the invention applies to footwear, and shoes in particular, including those compatible for use in other fields, such as those mentioned above.

The first embodiment is described below with reference to FIGS. 1 to 4.

Figure 1:
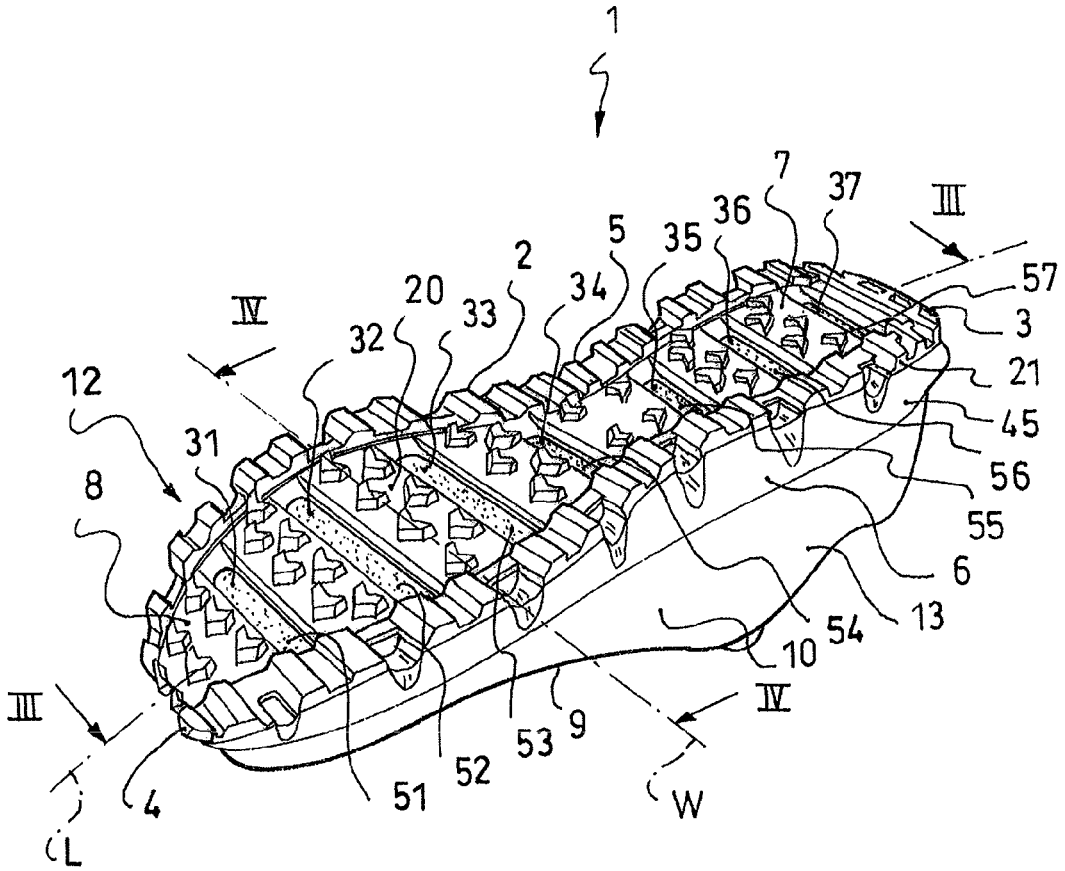
FIG. 1 is a front perspective bottom view of a shoe according to a first embodiment of the invention.
Figure 2:
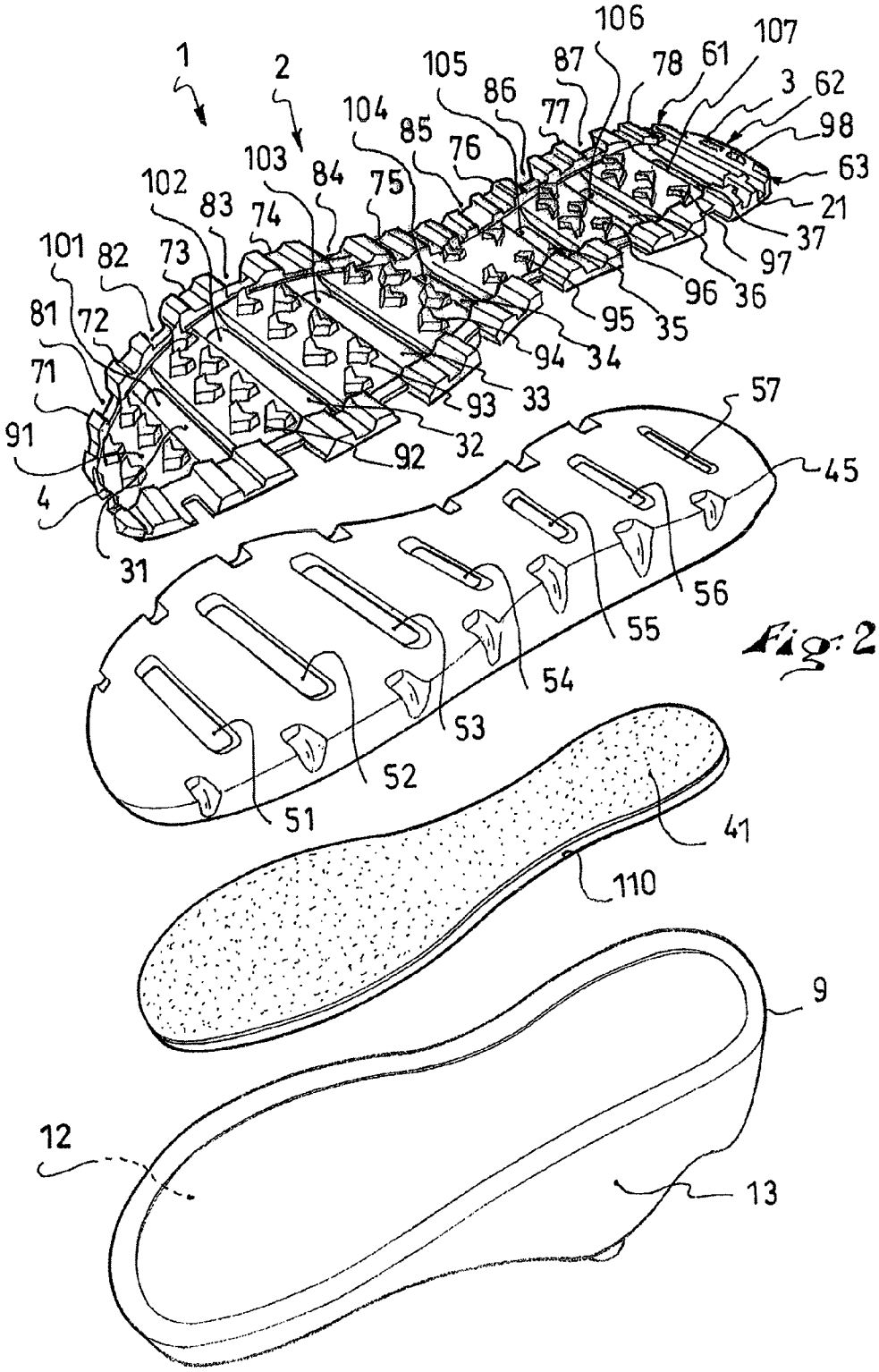
FIG. 2 is similar to FIG. 1, with an exploded presentation of the outer sole assembly.

As shown in FIGS. 1-2, a walking shoe is provided to receive the foot of a user.

Conventionally, and general speaking, the shoe 1 comprises an outer sole assembly 2, which extends along a longitudinal direction L between a rear end 3 and a front end 4, and along a transverse direction W between a lateral side 5 and a medial side 6. The sole assembly 2 comprises a rear portion 7, or heel, and a front portion 8, or forefoot. According to the first embodiment, the sole layer 21 of the sole assembly 2 is a unitary element, i.e., a single piece element, in the sense that the heel 7 and the front portion 8 are co-extensive. However, these portions 7, 8 could be separate and spaced apart.

In addition, the shoe 1 comprises an upper 9 arranged on the sole assembly. As shown, the upper 9 comprises a lower portion 10, provided to surround the foot, but is devoid of a top portion, i.e., its upper edge extends beneath the ankle of the wearer. However, the upper could be provided to also comprise a top portion. The upper 9 is not shown in detail.

The upper 9 can include a lateral quarter 12, a medial quarter 13, and a tongue. The tongue, not shown in the drawing figures, connects the quarters 12, 13 to one another, i.e., extends between the quarters, in order to provide continuity to the upper 9. However, the tongue could be omitted. In this case, the quarters 12, 13 can be separate or superimposed/overlapped.

A tightening device, not described in detail here, is generally provided to tighten the upper 9 reversibly. However, the shoe 1 could be devoid of a tightening device.

Regardless of the structure of the upper, the outer sole assembly 2 has a surface 20 for contact with the ground. By definition, this surface 20 is adapted to contact the ground or any of various supports. More concretely, as shown more clearly in FIG. 2, the outer sole assembly 2 includes a wear layer 21 provided to take support on the ground. It is this wear layer 21 that defines the contact surface 20.

According to the embodiment described, the wear layer 21 is a unitary element, i.e., a single piece element, which extends from the rear end 3 to the front end 4, and from the lateral side 5 to the medial side 6. In fact, the wear layer 21 extends along the entire contact surface 20. However, the wear layer 21 could also be provided to include a plurality of distinct, juxtaposed, or spaced apart portions.

In a non-limiting fashion, the wear layer 21 is comprised of rubber. This material indeed offers good ground grip characteristics. However, other synthetic materials with similar or equivalent grip properties can also be used.

According to the embodiment described, the wear layer 21 has at least one through-opening 31, 32, 33, 34, 35, 36, 37. This means that the wear layer 21 is perforated, thickness-wise, in the area of each opening 31 to 37. Here, the wear layer 21 has seven openings 31 to 37, but it could alternatively have a smaller or a larger number or openings. The openings lighten the outer sole assembly 2.

The outer sole assembly further comprises at least one reinforcing layer 41 arranged between the wear layer 21 and the upper 9, the reinforcing layer 41 extending at least in the area of the openings 31 to 37. More specifically, with respect to the first embodiment of the invention, the reinforcing layer 41 blocks each opening 31 to 37 of the wear layer 21 on its side 42 opposite the contact surface 20. This provides resistance to punctures or intrusions for all of the openings from 31 to 37.

Figure 3:
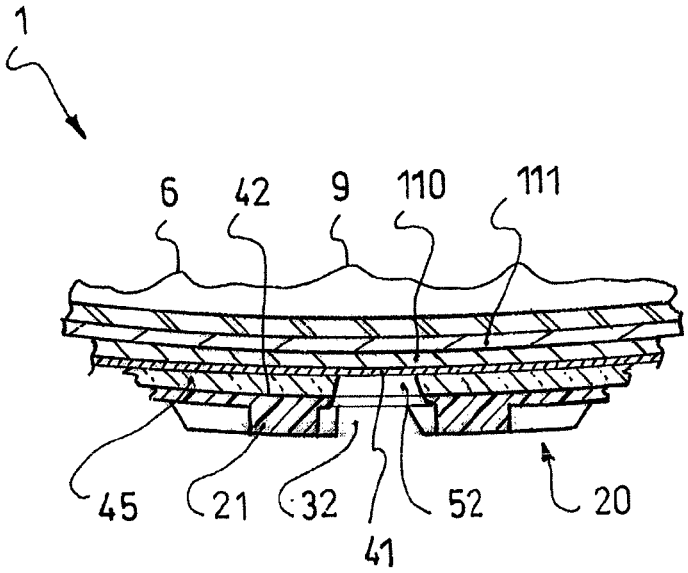
FIG. 3 is a cross-sectional view along the line III-III of FIG. 1.
Figure 4:
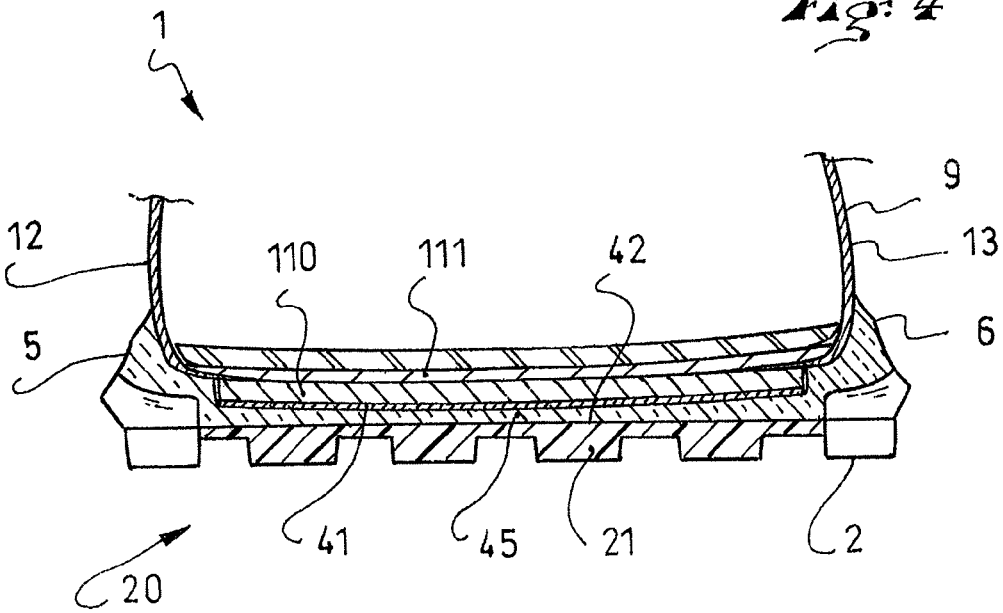
FIG. 4 is a cross-sectional view along the line IV-IV of FIG. 1.

According to the invention, a damping layer 45 is arranged between the wear layer 21 and the reinforcing layer 41. As shown in FIGS. 3 and 4, the damping layer 45 is in direct contact with the wear layer 21 and with the reinforcing layer 41. The damping layer 45 absorbs impacts, forces or other biases transmitted through the outer sole assembly 2, particularly between the wear layer 21 and the reinforcing layer 41. Indeed, the entirety or subdivisions of the damping layer 45 deform elastically and reversibly, in order to enable a relative displacement of the wear layer 21, or of subdivisions of this layer, with respect to the reinforcing layer 41. The deformations of the damping layer dissipate energy, which, consequently, increases the bias intensity required to cause the shoe to slip. These deformations also enable the wear layer to adapt better to the various shapes or projections of the ground. In other words, the ground-gripping ability is improved with the footwear of the invention. In the exemplary embodiment shown in both FIGS. 1 and 2, each of the wear layer 21, the damping layer 45, and the reinforcing layer 41 of the outer sole assembly 2 extends between the heel 7 and the forefoot 8. As further described below, a reinforcing layer need not extend as far as other layer(s) and, further, more than one reinforcing layer can be provided. In addition, as shown in FIGS. 1 and 4, the damping layer 45 is transversely wider than the upper 9. Also, the medial and lateral outer surfaces of the damping layer 45 form respective portions of the medial and lateral outer surfaces of outer sole assembly. Further, the medial and lateral outer surfaces of the damping layer extend upwardly higher than the reinforcing layer 41.

Still according to the first embodiment, as can be understood with reference to all FIGS. 1 to 4, the damping layer 45 has at least one opening 51, 52, 53, 54, 55, 56, or 57. This imparts a minimum mass on this layer 45. As a result, the shoe 1 remains light and user fatigue is reduced.

Generally speaking, at least one opening 51 to 57 of the damping layer 45 coincides with a respective opening 31 to 37 of the wear layer 21. This means that an opening of the damping layer 45 is aligned with an opening of the wear layer 21 thickness-wise of the outer sole assembly 2. Consequently, the reinforcing layer 41 seals the open cavity formed by both an opening of the wear layer 21 and an opening of the damping layer 45. It follows that the damping layer 45 absorbs impacts or forces at the periphery of one, or all, openings. This enables the shoe to have a good grip on rough terrain, especially when the wear layer 21 contacts a projection of the ground, in the area of an opening.

To optimize this damping characteristic, and without it being limiting, each opening 51 to 57 of the damping layer 45 coincides with a respective opening 31 to 37 of the wear layer 21. Given that the respective openings of the damping 45 and wear 21 layers are distributed over the entire outer sole assembly 2, damping is efficient everywhere beneath the shoe.

It is notable that at least one opening through-opening 31 to 37 of the wear layer 21 is a transverse slit, that is to say, it is oriented in the transverse direction W. Such slit has a generally elongated shape having a certain size in the longitudinal direction; but it could alternatively be rectangular, diamond-shaped, or the like. As shown in the exemplary embodiment of FIGS. 1 and 2, along respective longitudinally spaced-apart vertical transverse planes, the empty space occupied by the through openings occupy a majority of the respective transverse widths of the wear layer 21. That is, the length of each of the through openings 31 to 37 makes up a majority of the width of the wear layer 21 along the respective ones of the through openings. In any case, the slit promotes longitudinal bending of the outer sole assembly 2 for good foot rolling movement. Thus, each slit 31 to 37 is an open cavity on the side of the contact surface 20, such cavity cooperating with the projections of rough terrains for a better grip. Indeed, each contour of a slit 31 to 37 forms an obstacle to unwanted slips through cooperation with the terrain.

Consequently, in order to optimize the mechanical properties of the outer sole assembly 2, at least one opening 51 to 57 of the damping layer 45 is a transverse slit. Here again, the longitudinal bending of the outer sole assembly 2 is promoted for good foot rolling movement. According to the first embodiment, as generally described above, at least one slit of the damping layer is provided to be aligned with a slit of the wear layer. In non-limiting fashion, each slit 51 to 57 of the damping layer 45 is the extension of a respective slit 31 to 37 of the wear layer, thickness-wise of the sole assembly 2.

Still according to the first embodiment of the invention, the contact surface 20 has a plurality of successive lines or rows of projections and recesses, as described below, namely, a first line 61, a second line 62, and a third line 63, oriented in the longitudinal direction L. Alternatively, only two lines could be provided, or more than three lines; for example, four or five lines. In any case, the contact surface 20 has a first line 61, the first line 61 having alternating projections 71 to 78 and recesses 81 to 87. The contact surface 20 has a second line 62, the second line 62 having alternating projections 91 to 98 and recesses 101 to 107, the projections 71 to 78 and recesses 81 to 87 of the first line 61 being arranged alternately in relation to the projections 91 to 98 and recesses 101 to 107 of the second line 62. In addition, at least one recess 101 to 107 of a line 62 is demarcated, in the area of its perimeter, by a respective one of the openings 31 to 37 of the wear layer 21 and by an opening 51 to 57 of the damping layer 45. The second line 62 is contiguous with the first line 61, a projection of the second line being adjacent to a recess of the first line, and a recess of the second line being adjacent to a projection of the first line. The contiguous recesses and projections are therefore offset in the longitudinal direction. This enables an even and free rolling movement of the outer sole assembly 2 on even terrain, adequate grip on such terrain, and also reversible grip on uneven terrain. The shoe according to the first embodiment is therefore versatile. Described another way, with reference to the exemplary embodiment shown in FIGS. 1 and 2, a first transverse vertical plane of the wear layer that extends between a pair of through-openings, such as transversely between the pair of openings 32 and 33, extends not only transversely between the openings 32, 33, but through at least a medial recess that transversely borders the wear layer. Each of these recesses, in addition to being downwardly open, i.e., open in the direction of the wear surface 20, are outwardly open, as shown in FIGS. 1 and 2. Likewise, again with reference to FIGS. 1 and 2, a second transverse vertical plane of the wear layer that extends through one of the through openings, such as the opening 32, also extends through at least a medial projection that transversely borders the wear layer.

In addition, the reinforcing layer 41 extends completely in the area of at least one opening 31 to 37 of the wear layer 21 and of the associated opening 51 to 57 of the damping layer 45. This optimizes the resistance of the sole assembly 2 to punctures and also protects the user's foot from contact with pebbles and ground projections.

Similar to the wear layer 21, the damping layer 45 extends along the entire contact surface 20. In other words, the damping layer 45 extends from the rear end 3 to the front end 4, and from the lateral side 5 to the medial side 6. This renders the behavior of the outer sole assembly 2 uniform over the entire contact surface 20.

In a non-limiting fashion, the damping layer 45 is comprised of a plastic material foam, which can be ethyl vinyl acetate (EVA) or any equivalent material, for example.

The reinforcing layer 41 extends longitudinally by a value between 30% (for example, the reinforcing layer is located only at the front portion of the sole assembly) and 100% of the length of the sole assembly 2 (that is, the reinforcing layer is located at the heel as well as at the front portion of the sole assembly, such as at the forefoot region as shown in FIGS. 1 and 2). This makes it possible to seal the openings 31 to 37, and 51 to 57, but without occupying a zone devoid of openings. Here again, the goal is to reduce the mass of the outer sole assembly 2 as much as possible.

In a non-limiting fashion, the reinforcing layer 41 is comprised of a synthetic material, which can be polyurethane, polyamide, or any similar material, for example. The thickness of the reinforcement 41 can be between 0.1 and 2.0 mm, and values between 0.2 and 0.6 mm yield good results. This combines puncture resistance and bending ability. Good foot rolling movement is therefore preserved.

As shown in FIGS. 2, 3, and 4, a comfort layer 110 can further be arranged along the reinforcing layer 41, on the other side of the damping layer 45. In fact, this comfort layer 110 is positioned between the damping layer 45 and an insole 111. The goal is to optimize the compromise between transmission of forces or sensory information and comfort of the wearer's foot. It can have the same thickness as the damping layer 45, or it can be thicker to more greatly provide foot comfort.

Figure 5:
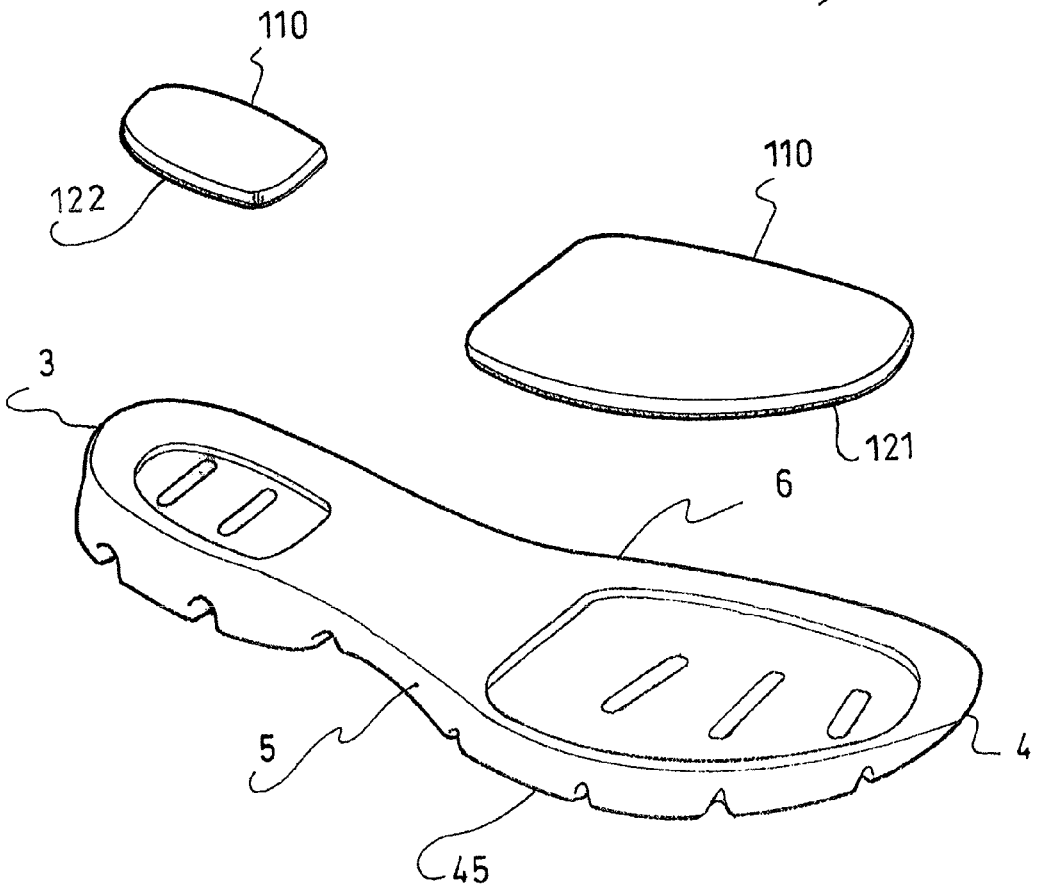
FIG. 5 is an exploded front perspective view of the elements of the outer sole assembly according to a second embodiment of the invention.

The second embodiment is described below with reference to FIG. 5. For convenience, the elements shared with the first embodiment are designated by the same reference numerals.

This embodiment also features a damping layer 45 of an outer sole assembly 2, with its ends 3, 4 and sides 5, 6. Specific to the second embodiment is the manner in which the openings are sealed. A plurality of reinforcing layers are used here, namely, first 121 and second 122 reinforcing layers, one of which is arranged toward the front of the sole assembly 2, and the other toward the rear. Each of these reinforcing layers 121, 122 can extend up to the medial side 6 and lateral side 5, respectively, of the sole assembly. This solution is suitable for a sole assembly having a reduced number of openings, or slits. A comfort layer 110 is also provided.

In each case, the reinforcing layer 121, 122 extends longitudinally, for example, by a value between 20 and 45% of the length of the sole assembly 2.

In any case, the invention is made from materials and using techniques of implementation known to one of ordinary skill in the art.

The invention is not limited to the embodiments described above, and includes all technical equivalents that fall within the scope of the claims that follow.

In particular, the openings of the outer sole assembly can be provided in various shapes.

Also, one or several layers, such as the wear layer or damping layer, can be comprised of a plurality of juxtaposed or spaced apart modules.

The invention provides for the outer sole assembly 2 to include only the wear layer 21, the damping layer 45, and the reinforcing layer 41 to solve the problem posed. As shown in the cross-sectional views of FIGS. 3 and 4, for example, the damping layer 45 is in direct contact with an upper surface of the wear layer 21 and the reinforcing layer 41 is in direct contact with an upper surface of the damping layer. However, additional layers may be included, for example, to obtain a gradation of the damping effect, a specific behavior in relation to moisture, or the like.

The invention disclosed herein by way of exemplary embodiments suitably may be practiced in the absence of any element or structure which is not specifically disclosed herein.

The invention claimed is:

1. An article of footwear comprising:

an upper;

an outer sole assembly;

the outer sole assembly having a length extending in a longitudinal direction from a rear end to a front end, and a width extending between a lateral side and a medial side;

the outer sole assembly comprising:

a wear layer including a contact surface provided to take support on the ground, the wear layer having an area with at least one through-opening;

a damping layer positioned above the wear layer, the damping layer having an area with at least one through opening aligned thickness-wise with a respective one of the at least one through-opening of the wear layer, thereby forming at least one open cavity that extends through both the wear layer and the damping layer; and at least one intrusion-blocking and sealing reinforcing layer positioned between an uppermost foot-supporting surface of the damping layer and the upper, the at least one intrusion-blocking and sealing reinforcing layer being configured to block and seal intrusions from passing through and out of the at least one open cavity.

2. An article of footwear according to claim 1, wherein: at least one of the at least one through-opening of the wear layer is a transverse slit.

3. An article of footwear according to claim 1, wherein: at least one of the at least one through-opening of the damping layer is a transverse slit.

4. An article of footwear according to claim 1, wherein: the contact surface comprises:

a first longitudinally extending row of alternating projections and recesses;

a second longitudinally extending row of alternating projections and recesses;

the first and second longitudinally extending rows of alternating projections and recesses being transversely adjacent;

the projections and recesses of the first row being arranged alternately in relation to the recesses and projections, respectively, of the second row; and at least one recess of the second row having a perimeter area demarcated by the at least one through-opening of the wear layer and the at least one through-opening of the damping layer.

5. An article of footwear according to claim 1, wherein: the reinforcing layer extends completely within the area with the at least one opening of the wear layer and within the area with the respective opening of the damping layer.

6. An article of footwear according to claim 1, wherein: the wear layer extends along an entirety of the contact surface.

7. An article of footwear according to claim 1, wherein: the wear layer is comprised of rubber.

8. An article of footwear according to claim 1, wherein: the damping layer extends along an entirety of the contact surface.

9. An article of footwear according to claim 1, wherein: the damping layer is comprised of a plastic material foam.

10. An article of footwear according to claim 1, wherein: the reinforcing layer extends longitudinally between 70% and 100% of the length of the outer sole assembly.

11. An article of footwear according to claim 1, wherein: the reinforcing layer extends longitudinally at least 20% and no greater than 45% of the length of the outer sole assembly.

12. An article of footwear according to claim 1, wherein: the reinforcing layer is comprised of a synthetic material.

13. An article of footwear according to claim 1, further comprising:

a comfort layer extending along a side of the reinforcing layer facing the upper and opposite the damping layer.

14. An article of footwear according to claim 11, wherein: the reinforcing layer is positioned in a front portion of the outer sole assembly and does not extend to a rear portion of the outer sole assembly.

15. An article of footwear according to claim 1, wherein: the reinforcing layer is a puncture-resisting layer.

16. An article of footwear according to claim 1, wherein: the damping layer extends lengthwise from a heel to a forefoot of the outer sole assembly.

17. An article of footwear according to claim 1, wherein: the at least one through-opening of the wear layer comprises a plurality of through-openings in a heel area of the outer sole assembly and a plurality of through-openings in a forefoot area of the outer sole assembly.

18. An article of footwear according to claim 1, wherein: the at least one through-opening of the wear layer comprises a plurality of transversely elongated through-openings; and each of the plurality of transversely elongated through-openings of the wear layer has a length that makes up a majority of a width of the wear layer along a respective one of the through-openings.

19. An article of footwear according to claim 18, wherein: a first transverse vertical plane of the wear layer extends between a pair of successive ones of the plurality of through-openings of the wear layer and extends through at least one projection and an outwardly open medial side recess.

20. An article of footwear according to claim 19, wherein: a second transverse vertical plane of the wear layer extends through one of the plurality of transversely elongated through-openings and extends at least through a medial side projection.

21. An article of footwear according to claim 1, wherein: each of the at least one through-opening of the damping layer extends from a lowermost surface of the damping layer to an uppermost surface of the damping layer.

22. An article of footwear according to claim 1, wherein: the reinforcing layer is designed to dampen less than the damping layer dampens.

23. An article of footwear according to claim 1, wherein: the reinforcing layer has a thickness between 1.0 mm and 2.0 mm.

24. An article of footwear according to claim 1, wherein: the reinforcing layer has a thickness between 2.0 mm and 6.0 mm.

25. An article of footwear according to claim 1, wherein: at least one of the at least one through-opening of the wear layer is transversely elongated between opposite ends of the one through-opening of the wear layer; and an entirety of the at least one transversely elongated through-opening of the wear layer, from a first of the opposite ends of the one through-opening of the wear layer to a second of the opposite ends of the one through-opening of the wear layer, extends along a direction perpendicular to the longitudinal direction.

26. An article of footwear according to claim 1, wherein: at least one of the at least one through-opening of the damping layer is transversely elongated between opposite ends of the one through-opening of the damping layer; and an entirety of the at least one transversely elongated through-opening of the damping layer, from a first of the opposite ends of the one through-opening of the damping layer to a second of the opposite ends of the one through-opening of the damping layer, extends along a direction perpendicular to the longitudinal direction.

27. An article of footwear according to claim 25, wherein: at least one of the at least one through-opening of the damping layer is transversely elongated between opposite ends of the one through-opening of the damping layer; and an entirety of the at least one transversely elongated through-opening of the damping layer, from a first of the opposite ends of the one through-opening of the damping layer to a second of the opposite ends of the one through-opening of the damping layer, extends along a direction perpendicular to the longitudinal direction.

28. An article of footwear according to claim 25, wherein: the at least one through-opening of the wear layer comprises a plurality of transversely elongated through-openings at least in a front portion of the outer sole assembly.

29. An article of footwear according to claim 28, wherein: a vertical plane transverse to the longitudinal direction of the outer sole assembly extends through at least one of the plurality of elongated through-openings of the wear layer and through material of which the wear layer is comprised; and a transverse extent of the at least one of the plurality of through-openings of the wear layer through which the vertical transverse plane extends makes up a majority of a width of the wear layer along the one of the plurality of through-openings.

30. An article of footwear according to claim 28, wherein: each of the plurality of transversely elongated through-openings of the wear layer has a length between opposite ends of respective ones of the plurality of transversely elongated through openings of the wear layer; and the length of each of the plurality of transversely elongated through-openings of the wear layer makes up a majority of a width of the wear layer along each of respective ones of the elongated through-openings of the front portion of the outer sole assembly.

31. An article of footwear according to claim 1, wherein: the damping layer extends from the front end of the outer sole assembly to the rear end of the outer sole assembly; and the damping layer comprises a portion of an outer surface of the medial side of the outer sole assembly and a portion of an outer surface of the lateral side of the outer sole assembly.

32. An article of footwear according to claim 1, wherein: the damping layer is in direct contact with an upper foot-supporting surface of the wear layer.

33. An article of footwear according to claim 32, wherein: the reinforcing layer is in direct contact with an upper foot-supporting surface of the damping layer.

34. An article of footwear according to claim 4, wherein:

the at least one through-opening of the wear layer comprises a plurality of through-openings in a heel area of the outer sole assembly and a plurality of through-openings in a forefoot area of the outer sole assembly.

35. An article of footwear according to claim 34, wherein:

the damping layer comprises a plurality of through-openings in a heel area of the outer sole assembly and a plurality of through-openings in a forefoot area of the outer sole assembly; and the damping layer comprises a portion of an outer surface of the medial side of the outer sole assembly and a portion of an outer surface of the lateral side of the outer sole assembly.

36. An article of footwear according to claim 1, further comprising:

a comfort layer above and in direct contract with the reinforcing layer; and the comfort layer having a shape of the reinforcing layer.

37. An article of footwear according to claim 36, further comprising:

an insole positioned above the comfort layer and in direct contact with the comfort layer.

* * * * *